United States Patent [19]

Bishton, Jr.

[11] 3,934,275

[45] Jan. 27, 1976

[54] OIL RECOVERY SYSTEM

[76] Inventor: Norris J. Bishton, Jr., 14636 Hilltree Road, Santa Monica, Calif. 90402

[22] Filed: Mar. 8, 1974

[21] Appl. No.: 449,534

Related U.S. Application Data

[63] Continuation of Ser. No. 212,594, Dec. 27, 1971, abandoned.

[52] U.S. Cl. ..... 4/10; 4/80; 4/DIG. 11; 210/167

[51] Int. Cl.[2] ..... E03D 5/016

[58] Field of Search ..... 4/1, 8, 10, 12, 76–79, 4/81, 89, 90, 95, 111, 114, 115, 131, 172.15–172.17, 249, 14, DIG. 3, DIG. 11, 80, 11; 210/152, 167 X, DIG. 21; 137/578

[56] References Cited

UNITED STATES PATENTS

| | | | |
|---|---|---|---|
| 1,528,003 | 3/1925 | Yarnall | 137/578 |
| 3,032,776 | 5/1962 | Obert | 4/1 |
| 3,038,169 | 6/1962 | O'Brien | 4/79 |
| 3,431,563 | 3/1969 | Rascov | 4/131 |
| 3,454,967 | 7/1969 | Corliss | 4/77 |
| 3,593,346 | 7/1971 | Katona | 4/10 |
| 3,634,891 | 1/1972 | Kemper | 4/10 |
| 3,662,888 | 5/1972 | Kemper | 4/10 X |
| 3,673,614 | 7/1972 | Claunch | 210/152 X |

FOREIGN PATENTS OR APPLICATIONS

| | | | |
|---|---|---|---|
| 121,356 | 6/1901 | Germany | 4/14 |

*Primary Examiner*—John W. Huckert
*Assistant Examiner*—Stuart S. Levy

[57] ABSTRACT

A two phase recirculating sanitary system is described in which the flushing fluid phase is temporarily stored in the toilet bowl while the waste phase in the storage tank is being drained. A controllable valve is inserted between the toilet bowl and the waste tank. Prior to draining the waste tank, the controllable valve is closed and the flushing fluid phase is pumped into the toilet bowl where it is stored. The waste tank is then drained and all waste material is removed. The controllable valve is then opened releasing the flushing fluid to cover the bottom portion of the waste tank and the system is ready for use.

4 Claims, 2 Drawing Figures

OIL RECOVERY SYSTEM

Figure 1:
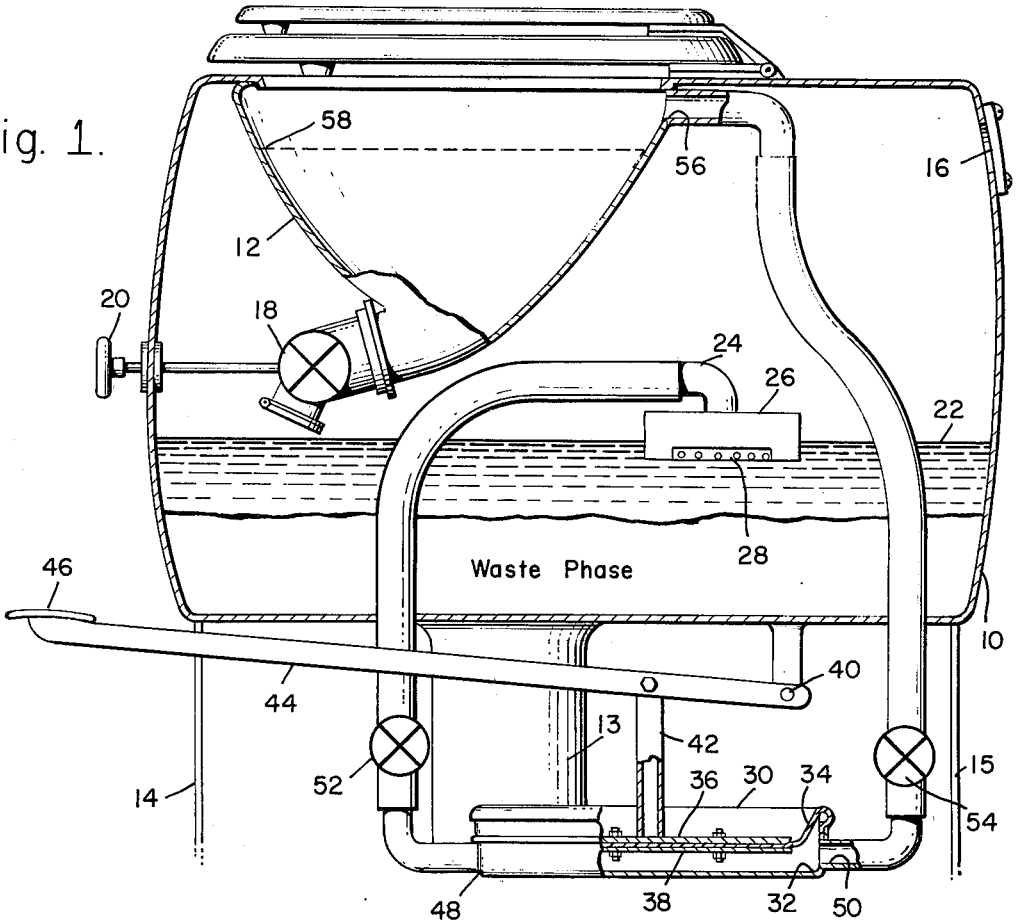

This is a continuation of application Ser. No. 212,594 filed Dec. 27, 1971 now abandoned.

This invention relates to a two phase recirculating sanitary system and more particularly to a two phase system in which the flushing fluid phase is stored in the toilet bowl while the contents of the waste tank are drained.

The most significant prior art is set forth in an application for patent entitled "Recirculating Toilet" by D. A. Dotson, J. M. Kemper and R. L. Rod, filed contemporaneously herewith and assigned to the same common assignee Ser. No. 395,936 filed Sept. 10, 1973, which is a continuation of Ser. No. 212,423 filed Dec. 27, 1971, now abandoned.

Until the advent of the copending patent application, two phase recirculating toilet systems were troubled by the problems associated with the separation and disposal of the flushing fluid phase.

The flushing fluid phase can be generally defined as a fluid that has a specific gravity that is less than that of the waste materials normally found in a recirculating toilet. The most popular flushing fluids used today in two phase systems have an oil base which serves the dual purposes of completely cleaning the toilet bowl of all waste material and also maintaining the flushing mechanism in a completely lubricated state at all times.

The flushing fluid, being lighter than the waste material, floats on the surface thereof in the waste tank. In the preferred embodiment a float holding an intake pipe is located on the surface of the flushing fluid and continuously skims the topmost portion of the fluid for use in the recirculating toilet. In prior art systems, when the waste tank was full of waste material, the waste tank was cleansed and drained and a new charge of flushing fluid was used. In order to achieve the benefits of a separate flushing fluid, the bottom portion of the waste tank should be filled to a depth of at least two inches, in order to effect the proper skimming action of the intake and to insure that the accumulated waste material is covered by the flushing fluid.

Unfortunately, when draining and cleaning the waste tank, both the flushing fluid and the waste material are removed and must be disposed of. In the conventional manner, the recirculating toilet is connected to a macerater pump which completely pulverizes and shreds the waste material.

The output of the macerater pump is then connected either to a conventional sewer line or to a privately maintained incinerator system. The flushing fluid being an oil based liquid is difficult to dispose of, since in many locations, it cannot be dispensed into the conventional sewer systems. Private incinerators also have problems with properly and completely disposing of flushing fluid. The present invention provides a convenient and proper means of holding the flushing fluid in a recirculating toilet system having extended connections to a sewer line.

As disclosed in the aforementioned patent application, a two phase recirculating system is highly desirable since the use of a separate flushing liquid has many advantages. A first is that the flushing fluid phase in the waste tank will cover the waste material in the waste tank and thereby seal the waste tank against the escape of any odors or other obnoxious smells that may have a tendency to be generated. A second, more important advantage comes from the lubricating qualities obtained from the use of an oil based flushing liquid in the pumping mechanisms associated with the recirculating system and in the toilet bowl itself as a flushing and lubricating liquid.

The use of such a special oil based flushing liquid eliminates the need for special deodorants and water colorants which are generally added at periodic intervals to the conventional recirculating toilet systems. However, unless the recirculating fluid can be conveniently and economically separated from the waste material, most of the above mentioned advantages of a two phase recirculating toilet are lost, since the cost of adding new flushing liquid and properly disposing of the old liquid can be prohibitively expensive.

The present invention discloses a method and apparatus for retaining the flushing liquid phase while draining and disposing of the waste phase. According to the present invention, the flushing fluid phase is temporarily stored in the toilet bowl itself when the waste tank is full of waste material and is cleaned. A controllable valve is located in the discharge line which connects the toilet bowl outlet with the waste tank.

Initially the waste tank is charged with the flushing preferably to a depth of at least two inches. The flushing fluid is continuously skimmed from the surface by an intake device which is connected to a suitable pump.

In normal operation, the operator either presses a button-switch if the pump is electrically or pneumatically controlled, or operates a lever if the pump is mechanically driven. Operation of the pumping mechanism draws a supply of flushing fluid from the surface of the waste tank and discharges the flushing fluid into the toilet bowl for flushing purposes.

When the waste tank is full, the controllable valve located between the toilet bowl and the waste tank is closed and the pumping mechanism is operated. The flushing fluid fills the toilet bowl which is then used as a means for temporarily storing the flushing fluid. The waste tank is then drained and cleaned of all waste material in the conventional manner.

For those applications where the waste tank is connected to a conventional sewer line, a macerater pump is used to completely shred the waste material for discharge into the sewer line. Since the flushing fluid phase has been substantially removed from the waste material phase there is no significant loss of flushing fluid when cleaning the tank, whether the tank is discharged through a macerater pump, through a conventional sewer line or discharged into a private incinerator system.

After the waste tank has been drained and cleaned the controllable valve is opened and the stored flushing fluid flows back into the waste tank. In the preferred embodiment, the capacity of the toilet bowl will be matched to the size of the waste tank so as to insure that the area at the bottom of the waste tank will be completely covered by the flushing fluid held by the toilet bowl.

The invention is highly adaptable for use with recirculating systems connected to conventional sewer lines as well as with those recirculating systems having no connections to either power or sewer lines.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not as a definition of the limits of the invention.

Figure 2:
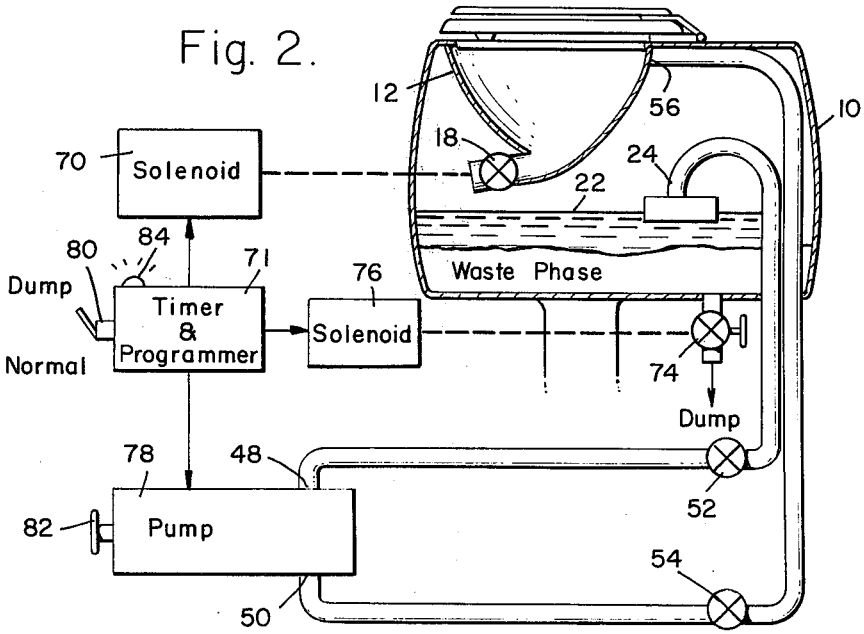

FIG. 1 is a schematic diagram illustrating a manually operated, two phase recirculating toilet system for use in a remote location; and FIG. 2 is a schematic diagram illustrating a completely automatic, recirculating two phase system for use in an application having power and sewer connections.

Referring now to FIG. 1, there is shown a waste tank 10 having a toilet bowl assembly 12 as an integral part thereof. The waste tank 10 is located on a pedestal 13 having a pair of skirts 14 and 15 to hide the operating parts of the toilet bowl assembly 12. An access opening 16 is located on one end of the tank 10 to thereby provide an opening for cleaning purposes.

The toilet bowl assembly 12 is integral with the waste tank 10 and is designed in a conventional shape to facilitate the discharge of the waste material and the flushing fluid through a controllable valve 18 into the receptacle provided in the waste tank 10. The opening or closing of valve 18 is achieved by means of a manual control 20 located on the outside of the waste tank 10 in an accessible position. The valve 18 is normally left open to allow the waste material and flushing fluid to be discharged from the toilet bowl assembly 12.

In the preferred embodiment, a sufficient amount of flushing fluid 22 is placed inside the waste tank 10 to cover the bottom portion of the waste tank to a depth of approximately two inches in order to insure that any waste material located within the interior of the waste tank will be fully covered and that all odors will be sealed by the action of the flushing fluid.

In order to obtain flushing fluid 22 for flushing purposes an intake pipe 24 is supported on the surface of the flushing fluid 22 by means of a suitable float 26 preferably constructed of foam or other light but bulky material that has high flotation qualities. The intake 24 is connected to a screen 28 located upon the bottommost portion of the float 26 to thereby insure that only the surface portion of the flushing fluid 22 will be drawn into the intake of the pipe 24.

In the self contained two phase recirculating system, a single diaphragm, foot operated pump 30 is used to siphon the surface of the flushing fluid 22. The pump 30 is comprised of a single chamber 32 covered by a diaphragm 34 that is reinforced by plates 36 and 38.

A foot operated pedal assembly having a fulcrum 40 is pivotally connected to member 42 that is fixedly attached to plate 36 for moving the diaphragm 34. An operating arm 44 is connected at one end to the fulcrum 40 and at the intermediate end to member 42 and at the opposite end to a pedal 46 which is adapted to be controlled by the foot of the user.

The pump 30 has only a single chamber 32 and hence could either have a single port with a suitable T-fitting or a pair of ports 48 and 50 as shown. Each port communicates with the chamber 32. The port 48 is an intake port and is connected to a ball and check valve 52 that will allow fluid to flow into port 48 but not out of the port. The valve 52 is connected with the intake pipe 24 which is supported by the float 26.

The port 50 is an output port for the chamber 32 and is in turn connected to a ball and check valve 54 that will allow fluid to flow out of the port 50 but not into the port. The output of the valve 54 is connected to an intake flushing port 56 associated with the toilet bowl assembly 12.

In operation, depressing the pedal 46 moves the operating arm 44 and member 42 in a downward direction thereby reducing the size of the chamber 32 formed by the diaphragm 34. If we assume this is the very first operation there will be no fluid in the chamber 32 and nothing will happen on the depressed down stroke. However, when the foot pedal 46 is released and the chamber 32 formed by the diaphragm 34 is enlarged, suction caused within the chamber will draw fluid from the waste tank 10 through the screen 28 and into the intake pipe 24, through the ball and check valve 52 into the intake port 48 thereby filling the chamber 32 with a charge of flushing fluid 22.

Again, depressing the pedal 46 will pressurize the chamber 32 causing the flushing fluid to be forced out of the output port 50, through the ball and check valve 54 and into the intake port 56 associated with the toilet assembly 12 thereby releasing a charge of flushing fluid into the toilet bowl assembly. With the valve 18 in the open position, the waste material and flushing fluid located within the toilet bowl assembly 12 will be discharged into the waste tank 10. Since the flushing fluid 22 has a specific gravity that is less than the waste material the flushing fluid will rise to the surface and float on the accumulated waste material.

As the waste material is accumulated, the level of the flushing liquid will rise, indicating that the waste tank 10 should be cleaned.

The method of preserving the flushing fluid is achieved by first operating handle 20 so as to close valve 18. The operator then depresses pedal 46 to pump flushing fluid 22 from the surface of the tank 10 into the toilet bowl 12. Depending upon the actual size of the toilet bowl 12, and the relative size of the tank 10, it may be necessary to repetitively pump pedal 46 to thereby fill the toilet bowl assembly 12 with the flushing fluid 22.

In one embodiment, a suitable indicia 58 will be located on the interior surface of the toilet bowl assembly 12 to indicate to the operator when a full condition is achieved. With the toilet assembly 12 filled with the flushing fluid 22, the access port 16 is opened and the interior of the waste tank 10 is cleansed of all of the accumulated waste material. When the cleaning procedure is finished the access port 16 is closed and secured and the operating control 20 is again manipulated to open the valve 18 to thereby allow the flushing fluid accumulated in the toilet bowl assembly 12 to now completely fill the bottommost portion of the waste tank 10.

The size of the toilet bowl assembly 12 and the waste tank 10 will be chosen so that a completely filled toilet bowl will hold a sufficient amount of flushing fluid 22 to completely cover the bottom portion of the tank 10 to a depth of approximately 2 inches.

The invention illustrated in FIG. 1 shows how the flushing fluid can be accumulated within the toilet bowl assembly during the cleaning operation of the waste tank without losing any substantial amount of the flushing liquid. Remote locations of recirculating toilet assemblies are usually serviced periodically by tank crews which may or may not have the necessary external equipment for cleaning the waste tank and for separating the flushing liquid from the waste material.

The advantages of the system illustrated in FIG. 1 are more apparent where professional cleaning crews are not available and where the individual owner must preserve the integrity of the flushing fluid in order to make the operation of a portable recirculating toilet assembly economically feasible.

Referring now to FIG. 2, there is shown a completely mechanized two phase recirculating toilet adaptable for use with the recirculating toilet known under the trademark MONOMATIC recirculating toilet. The MONOMATIC systems usually have access to electrical power for controlling the operation of the recirculating pump associated with the unit.

Market surveys have indicated that the public has a greater acceptance of a recirculating toilet system where a separate flushing liquid is used. The development of the two phase recirculating toilet system therefore has high commercial acceptance provided the flushing liquid can be reutilized and saved in an economical manner when the holding tank is discharged of the accumulated waste.

The system illustrated in FIG. 2 is similar in function to the corresponding portions illustrated in FIG. 1 and hence similar numbers are used wherever similar items are illustrated. The system contains a waste tank 10 in combination with a toilet bowl assembly 12 which has a controllable valve 18 for interrupting the charge of the waste material from the toilet bowl assembly 12 into the waste tank 10. Valve 18 is mechanically controlled by a solenoid 70 which is operated by a timer and programmer 71.

The waste tank 10 also includes a dump valve 74 usually attached to the waste tank at the lowermost point so as to facilitate the removal of the accumulated waste within the tank. The output of the valve 74 will, in the conventional MONOMATIC system be connected to a macerater type pump for pulverizing and grinding the accumulated waste material for eventual discharge into a sewer system. The valve 74 is mechanically controlled by a solenoid 76 which is also controlled by the timer and programmer 71.

The timer and programmer 71 has a dual position switch 80 having a first position labeled DUMP and a second position labeled NORMAL. In the conventional or normal operation, switch 80 will be in the NORMAL position which will thereby control solenoid 70 so as to open valve 18. Solenoid 76 will also be impulsed so as to close dump valve 74. The programming operation of the timer and programmer 71 will enable the pump 78 to be operated to the normal conventional manner by the operator or user simply pressing the operating switch or button 82 associated with the pump 78.

In the conventional operation, pushing button 82 will energize pump 78 thereby causing a circulation of the flushing fluid 22 from the surface of the waste tank 10, through the intake pipe 24, through a valve 52, through intake port 48, out the output port 50, through valve 54 and into the bowl assembly 12. The button 82 may be depressed any number of times to operate the pump 78 depending upon the needs of the system. It will be immediately recognized that depressing or even holding the button 82 does not waste or unduly use excess flushing fluid since the flushing fluid will simply be recirculating from the inside of the tank 10 through the pump and back to the toilet bowl assembly 12. With the toilet bowl assembly 12 cleaned to the operator's satisfaction, the button 82 will be released awaiting the next recycling of the flushing fluid.

Cleaning or dumping of the accumulated waste material within the waste tank 10 is achieved by repositioning switch 80 on the timer and programmer 71 to the DUMP position which has the effect of operating solenoid 70 to close valve 18. With switch 80 in DUMP position, button switch 80 is disabled and will not control the pump 78. The pump 78 is automatically programmed ON for a given period of time to pump the flushing fluid 22 into the toilet bowl assembly 12 at which time the pump is stopped. The timer and programmer 71 will stop the pumping operation and energize the control solenoid 76 so as to open the valve 74 for a period of time necessary to discharge the accumulated waste within the waste tank 10. Should the system also include a macerater pump then solenoid 76 will also operate the macerater pump for the programmed length of time necessary to discharge the accumulated waste material within the waste tank 10.

The timer and programmer 71 will program solenoid 76 for the necessary time period to effect the removal of all the waste material and at which time the solenoid will close the dump valve 74 and stop the operation of any associated macerater pump. The last step in the cycle is for the timer and programmer 71 to control the solenoid 70 so as to open the valve 18 to allow the accumulated flushing fluid within the toilet bowl assembly 12 to fill the bottom portion of the waste tank 10.

Completion of the programmed cycle will be indicated by a suitable light 84 or indicia on the timer and programmer which will indicate to the operator that switch 80 should now be placed in the NORMAL position which has the effect of disconnecting solenoid 70 and 76 from operation and place pump 78 under control of the operating button 82.

I claim:

1. The method of re-using flushing liquid used to flush a recirculating toilet system having a toilet bowl and a waste tank for receiving a mixture of human waste and flushing liquid therein and using a pumping mechanism to operate the flushing mechanism, the flushing liquid having a lower specific gravity than the specific gravity of said waste, said method comprising the steps of:

storing said flushing liquid in said waste tank on top of said waste;

closing a valve means between the toilet bowl discharge and the waste tank;

operating the pumping mechanism until essentially all of said flushing liquid in said tank is pumped directly from said mechanism into said toilet bowl thereby filling said bowl with essentially all of said flushing liquid;

subsequently emptying the waste tank of human waste while retaining essentially all of said flushing liquid in said bowl; and opening the connection between the toilet bowl discharge and the waste tank to return all of said flushing liquid in said bowl directly to said tank.

2. A method according to claim 1 which includes the steps of repetitively operating the pumping mechanism.

3. A method according to claim 1 in which the amount of flushing fluid held by said toilet bowl is sufficient to cover the bottom surface of the tank.

4. A method according to claim 1 which includes the step of using sufficient flushing fluid to completely cover the bottom surface of the waste tank.

* * * * *

UNITED STATES PATENT AND TRADEMARK OFFICE

CERTIFICATE OF CORRECTION

PATENT NO. : 3,934,275

DATED : January 27, 1976

INVENTOR(S) : Norris J. Bishton, Jr.

It is certified that error appears in the above-identified patent and that said Letters Patent are hereby corrected as shown below:

After the Inventor, the Assignee should be identified:

Assignee: Monogram Industries, Inc.
Santa Monica, California

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*